US008171870B2

(12) United States Patent
Gasper

(10) Patent No.: US 8,171,870 B2
(45) Date of Patent: May 8, 2012

(54) METHOD AND APPARATUS FOR DAMPENING RUDDER VIBRATION

(75) Inventor: Daniel L. Gasper, Merced, CA (US)

(73) Assignee: Malibu Boats LLC, Merced, CA (US)

( * ) Notice: Subject to any disclaimer, the term of this patent is extended or adjusted under 35 U.S.C. 154(b) by 278 days.

(21) Appl. No.: 12/572,987

(22) Filed: Oct. 2, 2009

(65) Prior Publication Data

US 2010/0083888 A1 Apr. 8, 2010

Related U.S. Application Data

(60) Provisional application No. 61/102,354, filed on Oct. 2, 2008.

(51) Int. Cl.
*B63H 25/10* (2006.01)

(52) U.S. Cl. ..... 114/144 R

(58) Field of Classification Search ..... 114/162, 114/165–170, 144 R, 144 RE
See application file for complete search history.

(56) References Cited

U.S. PATENT DOCUMENTS 1,661,369 A * 3/1928 Irgens ..... 440/52
3,826,213 A * 7/1974 Riebandt ..... 114/144 C

* cited by examiner

*Primary Examiner* — Daniel Venne
(74) *Attorney, Agent, or Firm* — Morgan, Lewis & Bockius LLP

(57) ABSTRACT

An apparatus is provided for dampening rudder vibration of a motorboat. The apparatus may include a tiller assembly rotatable about a pivot point adjacent the stern of the motorboat, the tiller assembly including a tiller arm extending in a first direction from the pivot point and configured to be rotated about the pivot point by a user, and/or a damper mounted on the tiller assembly extending in a second direction from the pivot point. The damper may be configured to rotate integrally with the tiller arm, and the damper may include a mass that is sufficient to dampen vibrations of the tiller. A method of using the apparatus for dampening rudder vibration is also disclosed.

17 Claims, 4 Drawing Sheets

METHOD AND APPARATUS FOR DAMPENING RUDDER VIBRATION

CROSS-REFERENCES TO RELATED APPLICATIONS

This application claims priority to U.S. Provisional Patent Application No. 61/102,354 filed Oct. 2, 2008, and entitled METHOD AND APPARATUS FOR DAMPENING RUDDER VIBRATION, the entire contents of which are incorporated herein for all purposes by this reference.

BACKGROUND OF THE INVENTION

1. Field of the Invention

This invention relates, in general, to an apparatus for dampening rudder vibration and methods for its use.

2. Description of Related Art

A typical motorboat is steered with a steering wheel operably connected to a rudder via a cable and tiller arm, or other suitable means. For example, rotational movement of the steering wheel causes linear motion through the cable, which in turn moves a tiller arm and the rudder. As the cable moves back-and-forth, it effects a back-and-forth or side-to-side pivoting motion on the tiller arm in a well known manner so as to pivot the rudder as desired and effect steering of the boat.

In certain instances, however, tension and compression within the cable and/or other factors may contribute to vibration of the rudder. For example, a boat may be prone to rudder vibration or chatter when the boat is traveling at a certain speed, or when the boat is being loaded onto a trailer. Such vibration or chatter may cause less than optimal steering control, undesired vibration propagating through the cable to the steering wheel, unwanted noise, and other undesired effects.

It would therefore be useful to provide suitable means which overcome the above and other disadvantages of known motorboat steering assemblies.

BRIEF SUMMARY OF THE INVENTION

One aspect of the present invention is directed to an apparatus for dampening rudder vibration of a motorboat. The apparatus may include a tiller assembly rotatable about a pivot point adjacent the stern of the motorboat, the tiller assembly including a tiller arm extending in a first direction from the pivot point and configured to be rotated about the pivot point by a user, and/or a damper mounted on the tiller assembly extending in a second direction from the pivot point. The damper may be configured to rotate integrally with the tiller arm, and the damper may include a mass that is sufficient to dampen vibrations of the tiller.

The first direction and the second direction may be at least about 90° apart. The first direction and the second direction may be substantially opposite one another. A center of mass of the damper may be disposed at a distance from the pivot point, wherein the distance may be less than about 50% of a length of the tiller arm. The damper may include an elongated member including a first and a second end, wherein the first end may be disposed at the pivot point, and wherein the second end including a width that may be larger than a width of the first end. The damper may include an elongated member including a first and a second end, wherein the first end may be disposed at the pivot point, and wherein the second end including a thickness that may be larger than a thickness of the first end. The damper may include an elongated member having a first and a second end. The first end may be disposed at the pivot point, and the second end may include a density that may be larger than a density of the first end.

The damper may include an elongated member having a first and a second end. The first end may be disposed at the pivot point, and the damper may further include a mass member at the second end. The mass member may include a width that may be larger than a width of the first end. The mass member may include a thickness that may be larger than a thickness of the first end. The mass member may include a density that may be larger than a density of the first end. A center of mass of the mass member may be disposed substantially in the second direction from the pivot point. A center of mass of the mass member may be displaced from the second direction.

The damper may include an elongated member including a first and a second end, wherein the first end may be disposed at the pivot point, and wherein the second end may be curved. The second end may be curved substantially in a circular arc. An end of the mass member may be curved. The end of the mass member may be curved substantially in a circular arc.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
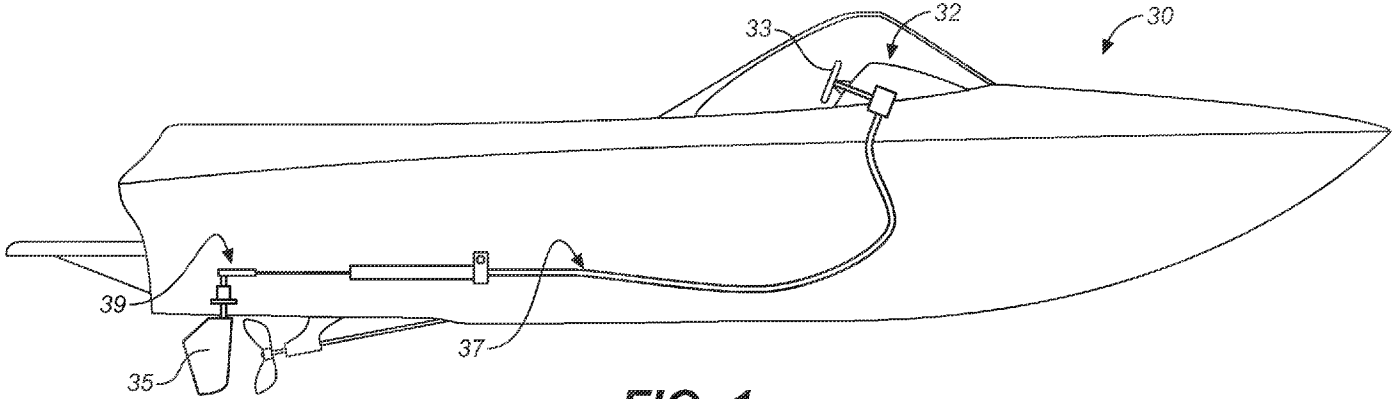
FIG. 1 is an elevational view of an motorboat for which an exemplary apparatus for dampening rudder vibration may be used in accordance with various aspects of the present invention.
Figure 2B:
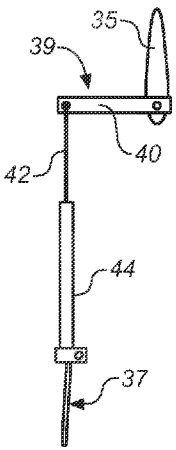
FIG. 2B is a plan view of an exemplary tiller arm and cable assembly that may be used on the motorboat of FIG. 1.
Figure 2A:
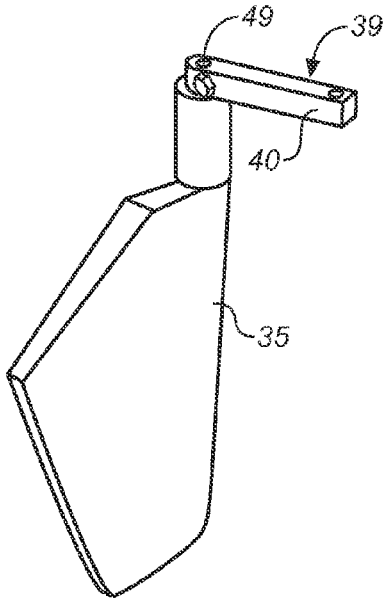
FIG. 2A is an enlarged perspective view of an exemplary rudder and tiller arm that may be used on the motorboat of FIG. 1.
Figure 4C:
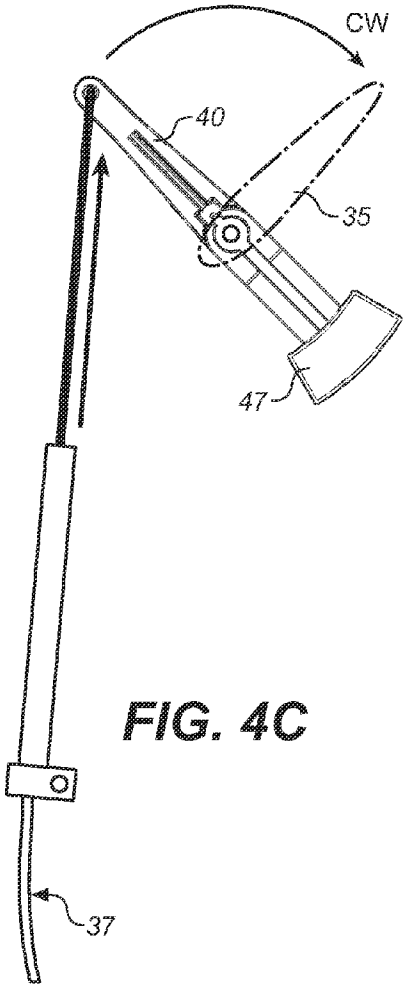
FIGS. 4A-C are plan views of the tiller and cable of FIG. 2B incorporating the an exemplary apparatus of FIG. 3A, each figure illustrating the rudder and tiller arm in left-turn, straight-ahead, and right-turn modes of operation.
Figure 4A:
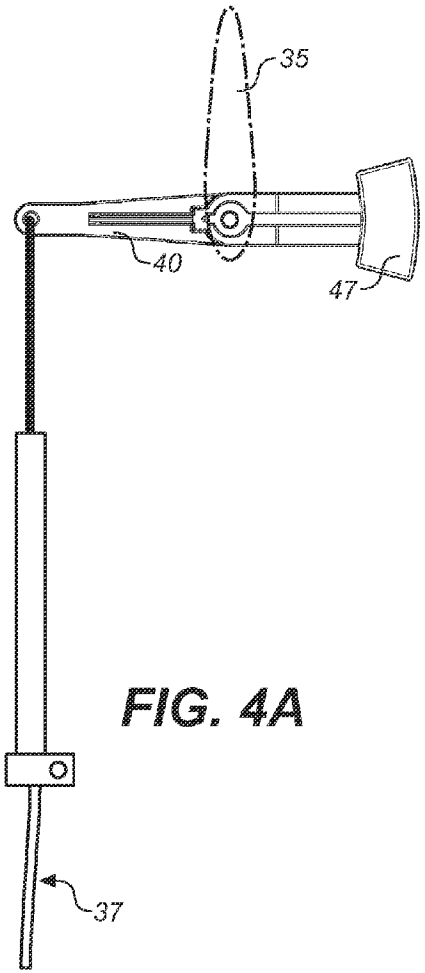
Figure 4B:
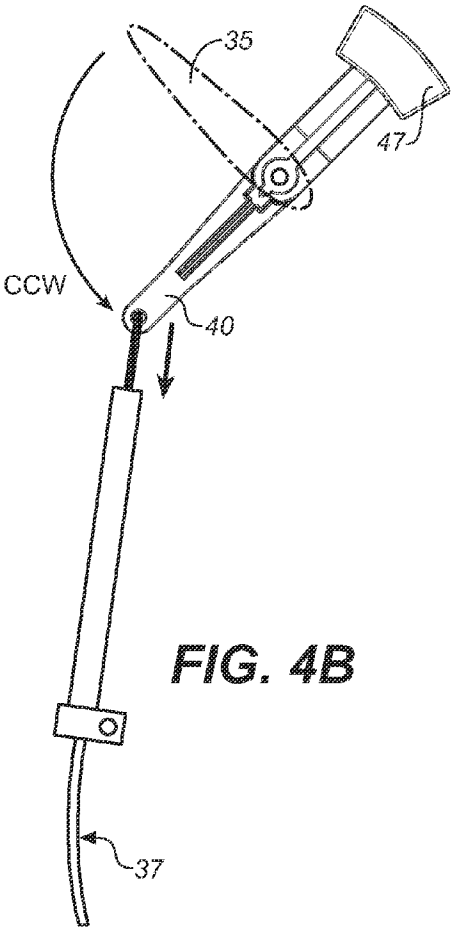

Turning now to the drawings, wherein like components are designated by like reference numerals throughout the various figures, attention is directed to FIG. 1 which illustrates a motorboat 30 having an otherwise conventional steering assembly 32 including a steering wheel 33 operably connected to a rudder 35 via a steering cable 37 and a tiller assembly 39 having a tiller arm 40. As the steering wheel is rotated left and right, rotational motion is applied to the cable by otherwise conventional means to case linear motion of an inner cable 42 relative to a cable housing 44. As the inner cable moves back-and-forth, tensile and compressive is applied by the cable on the tiller arm to effect pivoting motion of the rudder. For example, rotating the steering wheel to the left causes the inner cable to move forward in the manner illustrated by arrow F to cause tiller arm and rudder to rotate counterclockwise in the manner illustrated by arrow CCW to effect a leftward turn, as shown in FIG. 4B. Similarly, rotating the steering wheel to the right will effect a rightward turn, as shown in FIG. 4C, and returning the steering wheel to its neutral position will effect straightforward travel, as shown in FIG. 4A.

In accordance with the present invention, a dampening unit 46 The invention generally provides with a damper 47 attached to tiller arm 40. The damper can be of any construction useful in damping vibrations of the rudder 35. Exemplary embodiments of the damper are described below.

A tiller assembly 39 is rotatable about a pivot point 49 to steer motorboat 30. The tiller assembly includes tiller arm 40 extending in one direction, and damper 47 extending in another. The term "tiller arm" is used herein to mean the operable portion of the tiller assembly, i.e. the portion that is rotated by a user to rotate rudder 35 and steer the motorboat. In some embodiments, the tiller arm is rotated by steering wheel 33 via a cable 37, but other methods of rotation, such as direct manipulation by a user, are also within the scope of the invention. One will appreciate that the tiller assembly may have other suitable configurations in accordance with the present invention. For example, a tiller yoke and or other suitable means may be provided to translate the linear motion of the steering cable to rotating motion of the rudder.

The damper 47, as mentioned above, makes up the part of the tiller assembly 39 that extends in a direction other than the direction of the tiller arm 40. This may be any direction that is deemed appropriate by a person of ordinary skill in the art, based on the specific design requirements of the boat for which the tiller assembly is being used. The direction of the damper should preferably be spaced significantly apart from the direction of the tiller arm, such as by at least about 90°. In the illustrated embodiments, the two directions are substantially opposite one another.

Figure 3A:
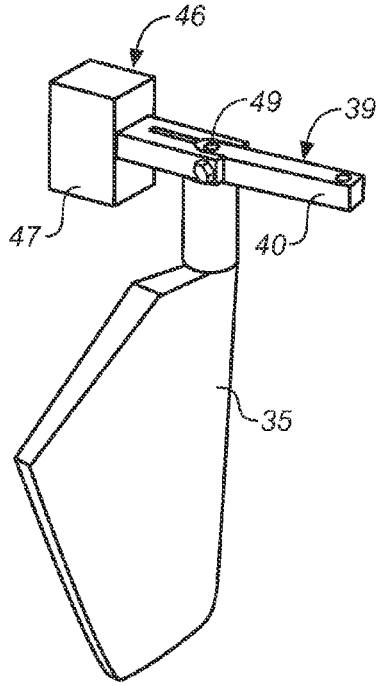
FIG. 3A is an enlarged perspective view of the rudder and tiller arm of FIG. 2A incorporating an exemplary apparatus for dampening rudder vibration in accordance with the present invention.
Figure 3B:
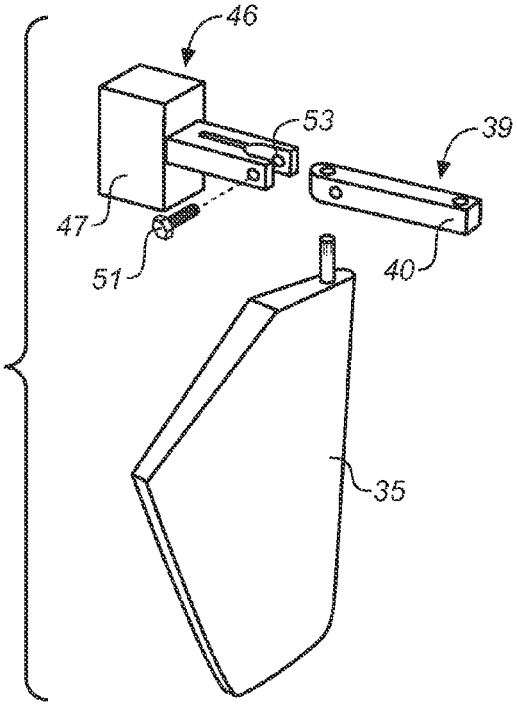
FIG. 3B is an exploded perspective view of the rudder and tiller arm of FIG. 3A.
Figure 5:
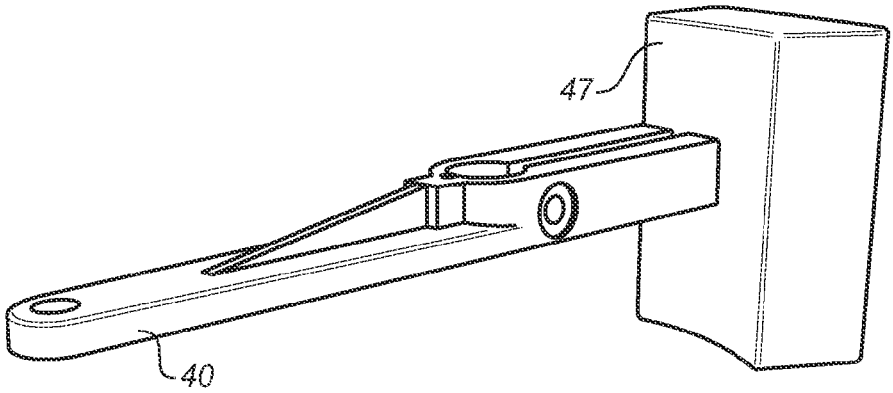
FIG. 5 is a perspective view of an exemplary apparatus for dampening rudder vibration may be used on the motorboat of FIG. 1 in accordance with various aspects of the present invention.

The damper 47 moves integrally with the tiller arm 40 and rudder 35. To this end, it may be cast or otherwise formed as a single piece with the tiller arm, as illustrated in FIG. 5. Alternatively, it may be made separately and attached to the tiller arm, such as with a bolt 51 and bolt holes 53, as illustrated in FIGS. 3A and 3B.

Generally, the damper 47 has a mass that is sufficient to damp vibrations and chatter of the rudder 35 and tiller arm 40. One will appreciate that the actual mass may vary with the dimensions and shape of the rudder, the dimensions and configuration of the tiller assembly, and other assorted design criteria. Any tiller that has a significant amount of mass located in a direction other than the direction of the tiller arm may serve to dampen vibration and chatter in accordance with various aspects of the present invention.

To achieve optimal results, the center of mass of the damper 47 should be spaced some distance apart from the pivot point 49. This may be accomplished in various ways. In the illustrated embodiments, the damper 47 is made up of an elongated member or rod 56, and mass member 54 attached to the end of the rod. Depending, of course, on the dimensions and densities of the rod and mass member, the center of mass of the illustrated embodiments can sometimes be approximated as the center of mass of the mass member. It is preferable that the center of mass of the damper 47 is displaced from the pivot point 49 by a distance that is at preferably less the length of the tiller arm 40, and, in the illustrated embodiments, this distance is approximately equal to the length of the tiller arm.

One will appreciate, however, that the mass and distance of the mass member may vary in order to provide a suitable moment arm. For example, depending upon design constraints, in some instances it may be beneficial to locate a very heavy mass member very close to the pivot point, while in other cases it may be advantageous to locate a relatively light mass member relatively far form the pivot point.

While the illustrated embodiments of the damper 47 include a mass member 54 that is both wider and thicker than the rod 56, other embodiments are within the scope of the appended claims. For example and without limitation, the damper may not include a separate mass member, but may instead be a single elongated member having a tapered shape that grows wider, thicker, or both towards its distal end. Some embodiments may include a mass member of a different, denser material than that of the rod 56. In these embodiments, the mass member may or may not be wider and/or thicker than the rod 56. Still other embodiments may include a small, dense mass member embedded within the material of the rod 56. Any configuration that provides a mass of sufficient size, and a center of mass at a sufficient distance from the pivot point, is within the scope of the invention.

Figure 6A:
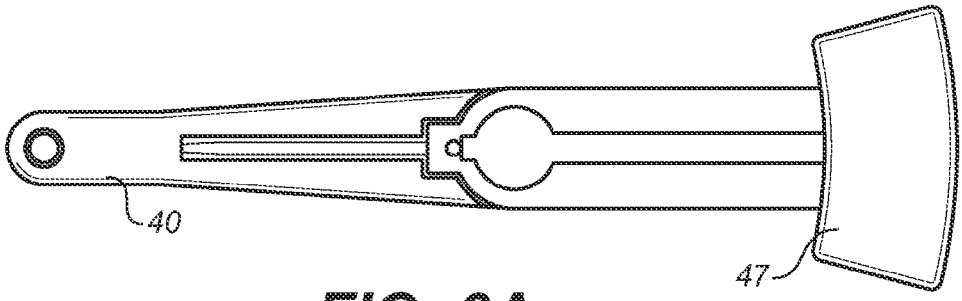
FIGS. 6A and 6B are plan views of other exemplary apparatuses for dampening rudder vibration may be used on the motorboat of FIG. 1 in accordance with various aspects of the present invention.
Figure 6B:
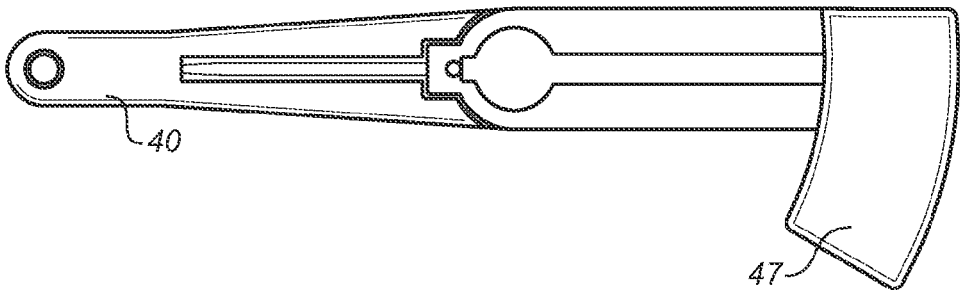

Turning now to FIGS. 6A and 6B, in some embodiments, one end 58 of the mass member 54 is curved, such as in the circular arc shown. This configuration may be useful in boats where space is particularly limited. When the motorboat is being steered, the tiller assembly 39 rotates around the pivot point 49 such that the end 58 of the mass member traces a circular arc. Therefore, the illustrated shape helps ensure that there is ample space for a mass member of sufficient size.

As shown in FIG. 6A, the mass member 54 may be placed centrally on the rod 56, i.e. such that its center of mass is along the axial direction of the rod (assuming uniform density in the mass member of FIG. 6A). If there are additional spatial restraints, however, this does not necessarily have to be the case. As shown in FIG. 6B, the mass member may be placed somewhere other than centrally on the rod, i.e. such that its center of mass is displaced from the axial direction of the rod (again, assuming uniform density). One will appreciate that the specific angle between the rod and the direction of center of mass of the damper may have little or no effect on damping characteristics.

The amount of mass and its distance from the pivot point 49, on the other hand, are important variables in achieving desired damping characteristics, and can, of course, be selected by a person of ordinary skill in the art for the particular boat in which they are being used through routine experimentation.

For convenience in explanation and accurate definition in the appended claims, the terms "left" or "right", "counterclockwise" or "clockwise", "forward" and "rearward", and other relative terms are used to describe features of the exemplary embodiments with reference to the positions of such features as displayed in the figures and are not intended to be limiting, absolute terms.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An apparatus for dampening rudder vibration of a motorboat, the apparatus comprising:

a tiller assembly rotatable about a pivot point adjacent a stern of the motorboat, the tiller assembly including a tiller arm extending in a first substantially horizontal direction from the pivot point and rotating about the pivot point; and a damper mounted on the tiller assembly extending in a second substantially horizontal direction from the pivot point, wherein the damper rotates integrally with the tiller arm, and wherein the damper includes a mass to dampen vibrations of the tiller.

2. The apparatus of claim 1, wherein the first direction and the second direction are at least about 90° apart.

3. The apparatus of claim 2, wherein the first direction and the second direction are substantially opposite one another.

4. The apparatus of claim 1, wherein a center of mass of the damper is disposed at a distance from the pivot point, wherein the distance is less than about 50% of a length of the tiller arm.

5. An apparatus for dampening rudder vibration of a motorboat, the apparatus comprising:

a tiller assembly rotatable about a pivot point adjacent a stern of the motorboat, the tiller assembly including a tiller arm extending in a first direction from the pivot point and rotating about the pivot point; and a damper mounted on the tiller assembly extending in a second direction from the pivot point, wherein the damper rotates integrally with the tiller arm, and wherein the damper includes a mass to dampen vibrations of the tiller;

wherein the damper comprises an elongated member including a first and a second end, wherein the first end is disposed at the pivot point, and wherein the second end including a width that is larger than a width of the first end.

6. An apparatus for dampening rudder vibration of a motorboat, the apparatus comprising:

a tiller assembly rotatable about a pivot point adjacent a stern of the motorboat, the tiller assembly including a tiller arm extending in a first direction from the pivot point and rotating about the pivot point; and a damper mounted on the tiller assembly extending in a second direction from the pivot point, wherein the damper rotates integrally with the tiller arm, and wherein the damper includes a mass to dampen vibrations of the tiller;

wherein the damper comprises an elongated member including a first and a second end, wherein the first end is disposed at the pivot point, and wherein the second end including a thickness that is larger than a thickness of the first end.

7. An apparatus for dampening rudder vibration of a motorboat, the apparatus comprising:

a tiller assembly rotatable about a pivot point adjacent a stern of the motorboat, the tiller assembly including a tiller arm extending in a first direction from the pivot point and rotating about the pivot point; and a damper mounted on the tiller assembly extending in a second direction from the pivot point, wherein the damper rotates integrally with the tiller arm, and wherein the damper includes a mass to dampen vibrations of the tiller;

wherein the damper comprises an elongated member including a first and a second end, wherein the first end is disposed at the pivot point, and wherein the second end including a density that is larger than a density of the first end.

8. An apparatus for dampening rudder vibration of a motorboat, the apparatus comprising:

a tiller assembly rotatable about a pivot point adjacent a stern of the motorboat, the tiller assembly including a tiller arm extending in a first direction from the pivot point and rotating about the pivot point; and a damper mounted on the tiller assembly extending in a second direction from the pivot point, wherein the damper rotates integrally with the tiller arm, and wherein the damper includes a mass to dampen vibrations of the tiller;

wherein the damper comprises an elongated member including a first and a second end, wherein the first end is disposed at the pivot point, and wherein the damper further including a mass member at the second end.

9. The apparatus of claim 8, wherein the mass member comprises a width that is larger than a width of the first end.

10. The apparatus of claim 8, wherein the mass member comprises a thickness that is larger than a thickness of the first end.

11. The apparatus of claim 8, wherein the mass member comprises a density that is larger than a density of the first end.

12. The apparatus of claim 8, wherein a center of mass of the mass member is disposed substantially in the second direction from the pivot point.

13. The apparatus of claim 8, wherein a center of mass of the mass member is displaced from the second direction.

14. An apparatus for dampening rudder vibration of a motorboat, the apparatus comprising:

a tiller assembly rotatable about a pivot point adjacent a stern of the motorboat, the tiller assembly including a tiller arm extending in a first direction from the pivot point and rotating about the pivot point; and a damper mounted on the tiller assembly extending in a second direction from the pivot point, wherein the damper rotates integrally with the tiller arm, and wherein the damper includes a mass to dampen vibrations of the tiller;

wherein the damper comprises an elongated member including a first and a second end, wherein the first end is disposed at the pivot point, and wherein the second end is curved.

15. The apparatus of claim 14, wherein the second end is curved substantially in a circular arc.

16. The apparatus of claim 8, wherein an end of the mass member is curved.

17. The apparatus of claim 16, wherein the end of the mass member is curved substantially in a circular arc.

* * * * *